US008590784B1

(12) United States Patent
Pernici et al.

(10) Patent No.: US 8,590,784 B1
(45) Date of Patent: Nov. 26, 2013

(54) CREDIT CARD SWIPE SLEEVE AND METHOD

(76) Inventors: Nicholas A. Pernici, Shreveport, LA (US); T. Scott Pernici, Shreveport, LA (US)

( * ) Notice: Subject to any disclaimer, the term of this patent is extended or adjusted under 35 U.S.C. 154(b) by 0 days.

(21) Appl. No.: 13/199,427

(22) Filed: Aug. 30, 2011

(51) Int. Cl.
*G06K 5/00* (2006.01)

(52) U.S. Cl.
USPC ..... 235/380; 235/383

(58) Field of Classification Search
USPC ..... 235/380, 383, 451, 492
See application file for complete search history.

(56) References Cited

U.S. PATENT DOCUMENTS

| | | | | |
|---|---|---|---|---|
| 4,711,347 | A | 12/1987 | Drexler et al. | |
| 4,722,376 | A | 2/1988 | Rhyner | |
| 4,851,610 | A | 7/1989 | LeBlanc et al. | |
| 5,326,964 | A * | 7/1994 | Risser | 235/487 |
| 5,700,036 | A * | 12/1997 | Smith, III | 283/72 |
| 5,941,375 | A | 8/1999 | Kamens et al. | |
| 6,543,809 | B1 | 4/2003 | Kistner et al. | |
| 6,845,863 | B1 | 1/2005 | Riley | |
| 6,899,276 | B2 | 5/2005 | Limelette et al. | |
| 7,005,170 | B1 * | 2/2006 | Simpson et al. | 428/40.1 |
| 7,988,061 | B2 * | 8/2011 | Cook et al. | 235/493 |
| 8,181,883 | B1 * | 5/2012 | Franklin | 235/493 |
| 2003/0094498 | A1 * | 5/2003 | Jones et al. | 235/487 |
| 2006/0262655 | A1 | 11/2006 | Persson | |
| 2009/0260731 | A1 * | 10/2009 | Roth et al. | 150/147 |
| 2010/0243741 | A1 | 9/2010 | Eng | |

* cited by examiner

*Primary Examiner* — Ahshik Kim
(74) *Attorney, Agent, or Firm* — R. Keith Harrison

(57) ABSTRACT

An illustrative embodiment of a credit card swipe sleeve includes a pair of sleeve panels, a plurality of panel seams attaching the sleeve panels, a sleeve interior defined by and between the sleeve panels, the sleeve interior generally approximating dimensions of a standard-sized credit card and a flexible sleeve rim carried by the pair of sleeve panels and deployable from an outwardly-expanded open configuration to a closed configuration responsive to inward pressure applied to the sleeve rim.

18 Claims, 8 Drawing Sheets

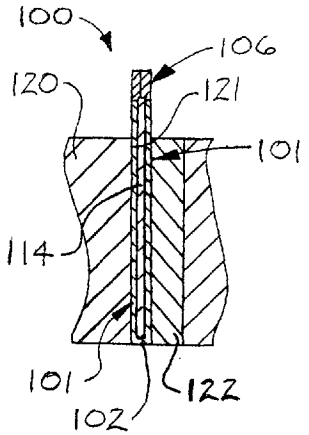
FIG. 8
FIG. 9
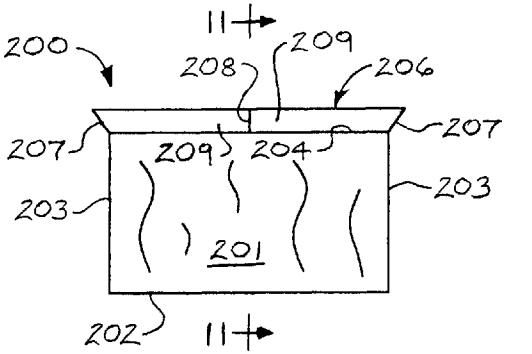
FIG. 10
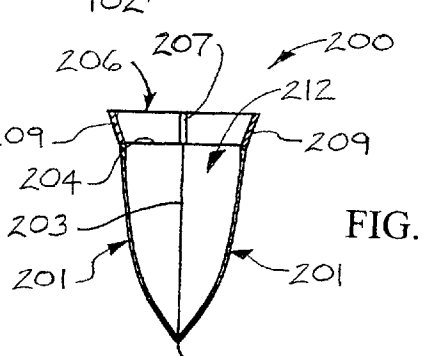
FIG. 11
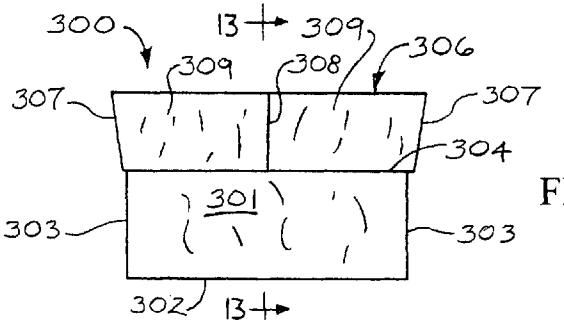
FIG. 12
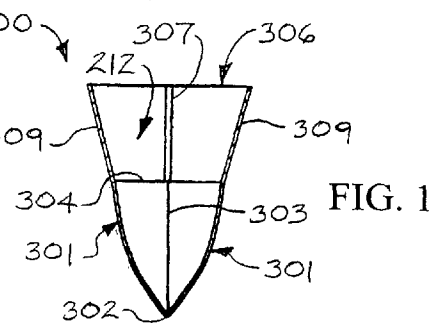
FIG. 13

CREDIT CARD SWIPE SLEEVE AND METHOD

FIELD

The disclosure generally relates to credit cards. More particularly, the disclosure relates to a credit card swipe sleeve and a method in which a credit card swipe sleeve contains a credit card and enhances accurate reading of the credit card as the credit card is swiped in a credit card reading device.

BACKGROUND

Credit cards are used every day by millions of people worldwide to disburse payment for goods and services. A standard credit card includes a magnetic stripe on which is encoded data about the credit card account. The magnetic stripe includes fine magnetic particles which are embedded in a plastic-like film and can be magnetized. Credit card account data can be stored, written or encoded on the magnetic stripe by magnetizing the magnetic particles in the stripe.

Proprietors of goods and services who accept credit cards as a form of payment from customers maintain a credit card reading device which deciphers the encoded credit card account data on the magnetic stripe for the purpose of conducting a financial transaction. The credit card reading device includes a card slot which is sized to receive the credit card. As the credit card is gripped and slid or "swiped" through the card slot of the credit card reading device, a small induction coil in the device detects a succession of magnetic and non-magnetic zones in the magnetic stripe of the credit card. As the magnetic zones on the stripe pass the induction coil, the coil generates electrical pulses. The device deciphers the electrical pulses and credits the transaction to the cardholder's account accordingly.

One of the drawbacks of using a conventional credit card having a magnetic stripe is that the magnetic stripe on the card is vulnerable to scratches and other defects, particularly if the card is used often. As the credit card reading device reads the credit card during swiping of the card, a scratch or other defect in the magnetic stripe may cause a spike in the pulses created by the induction coil in the device. An excessively-sensitive credit card reading device may misinterpret the spike in the pulses. Consequently, the account data which is encoded on the magnetic stripe may not be deciphered correctly and the sale for goods or services may be declined.

A common method of ameliorating the effects of scratches or other defects in the magnetic stripe on a credit card involves wrapping the credit card in a plastic bag and holding the wall of the plastic bag flat against the side of the credit card on which the magnetic stripe appears. As the credit card is subsequently swiped through the card slot of the credit card reading device, the thickness of the plastic bag wall increases the distance between the credit card reading device and the magnetic stripe, thus reducing the strength of the pulses and smoothing out fluctuations or spikes in the pulses. This pulse attenuating effect often enables the credit card reading device to correctly read or decipher the data encoded on the magnetic stripe and authorize the sale.

Use of a conventional plastic bag to swipe a credit card in a credit card reading device has several drawbacks. The availability of a plastic bag which is suitable for the purpose may be lacking when it is desired to conduct a financial transaction using a credit card. Moreover, wrapping the credit card in the bag in such a manner that the wall of the bag is placed flat against the side of the credit card having the magnetic stripe is a cumbersome and laborious exercise and typically requires experience to properly execute.

Accordingly, a credit card swipe sleeve and a method which enhances accurate reading of a credit card as the credit card is swiped in a credit card reading device are needed.

SUMMARY

The disclosure is generally directed to a credit card swipe sleeve which enhances accurate reading of a credit card as the credit card is swiped in a credit card reading device. An illustrative embodiment of the credit card swipe sleeve includes a pair of sleeve panels, a plurality of panel seams attaching the sleeve panels, a sleeve interior defined by and between the sleeve panels, the sleeve interior generally approximating dimensions of a standard-sized credit card and a flexible sleeve rim carried by the pair of sleeve panels and deployable from an outwardly-expanded open configuration to a closed configuration responsive to inward pressure applied to the sleeve rim.

In some embodiments, the credit card swipe sleeve may include a pair of sleeve panels; a plurality of panel seams attaching the sleeve panels; a sleeve interior defined by and between the sleeve panels, the sleeve interior generally approximating dimensions of a standard-sized credit card; and a flexible sleeve rim carried by the pair of sleeve panels and having a pair of generally elongated, spaced-apart sleeve rim tabs.

The disclosure is further generally directed to a credit card swipe method. An illustrative embodiment of the credit card swipe method includes providing a credit card swipe sleeve having sleeve panels, a sleeve interior generally approximating dimensions of a standard-sized credit card defined by and between the sleeve panels and a sleeve rim on the sleeve panels; inserting a credit card in the sleeve interior of the credit card swipe sleeve; applying the sleeve rim of the credit card swipe sleeve against opposite surfaces of the credit card; and swiping the credit card swipe sleeve in a credit card reading device.

BRIEF DESCRIPTION OF THE DRAWINGS

The disclosure will now be made, by way of example, with reference to the accompanying drawings, in which:

FIG. 8 is a front view of the credit card reading device as the credit card swipe sleeve and the credit card contained therein (illustrated in phantom) are swiped in the credit card reading device;

FIG. 9 is a sectional view which illustrates the credit card swipe sleeve maintaining physical separation or spacing between the credit card contained in the sleeve and the credit card reading device as the credit card swipe sleeve and credit card are swiped in the credit card reading device;

FIG. 10 is a side view of an alternative illustrative embodiment of the credit card swipe sleeve;

FIG. 11 is a transverse sectional view taken along section lines 11-11 in FIG. 10;

FIG. 12 is a side view of another alternative illustrative embodiment of the credit card swipe sleeve;

FIG. 13 is a transverse sectional view taken along section lines 13-13 in FIG. 12;

DETAILED DESCRIPTION

Figure 1:
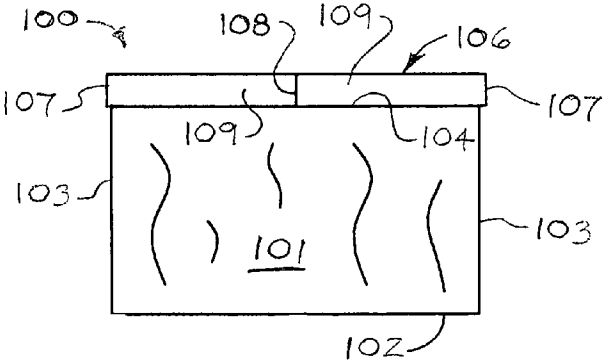
FIG. 1 is a side view of an illustrative embodiment of a credit card swipe sleeve.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Referring initially to FIGS. 1-9 of the drawings, an illustrative embodiment of the credit card swipe sleeve is generally indicated by reference numeral 100. As will be hereinafter further described, the credit card swipe sleeve 100 may be sized and configured to contain a credit or debit card (hereinafter credit card) 114 (FIG. 5) having a magnetic stripe 115. The credit card swipe sleeve 100 maintains distance or spacing between the magnetic strip 115 on the credit card 114 and a card reading mechanism 122 (FIG. 9) in a credit card reading device 120 as the credit card 114 is swiped in the credit card reading device 120. Accordingly, the spacing between the magnetic stripe 115 and the card reading mechanism 122 enhances accuracy of the credit card reading device 120 in reading the credit card account data encoded on the magnetic strip 115 and eliminates or reduces the likelihood that the card reading mechanism 122 will decline the credit card 114. Relative terms such as "front", "top", "bottom" and "side" are used for descriptive purposes herein and indicate the positions of the various components of the credit card to the corresponding portions of the credit card reading device 120 in exemplary application of the credit card swipe sleeve 100. Accordingly, such relative terms as used herein are not intended to be construed in a limiting sense as the credit card reading device 100 may be used in alternative applications in which such relative terms do not apply.

As illustrated in FIGS. 1-4, the credit card swipe sleeve 100 may include a pair of adjacent sleeve panels 101. Each of the sleeve panels 101 may be generally rectangular in shape. The sleeve panels 101 may be connected along a longitudinal panel seam 102 and along opposite lateral panel seams 103. Each sleeve panel 101 may have a top panel edge 104 which may be generally parallel to the longitudinal panel seam 102 and generally perpendicular to the lateral panel seams 103. A sleeve interior 112 may be defined by and between the sleeve panels 101. The sleeve interior 112 may generally approximate the dimensions of a standard-sized credit card 114. For example and without limitation, in some embodiments the sleeve interior 112 may generally have dimensions of 85.60 mm×53.98 mm×0.76 mm.

Figure 2:
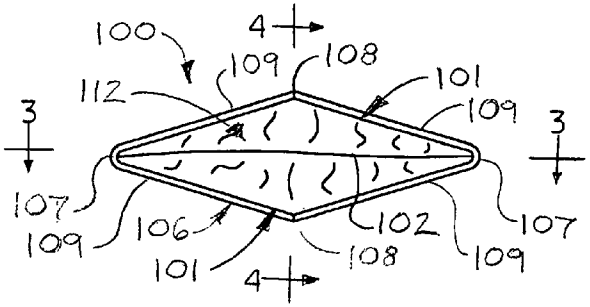
FIG. 2 is a top view of the illustrative credit card swipe sleeve illustrated in FIG. 1.
Figure 3:
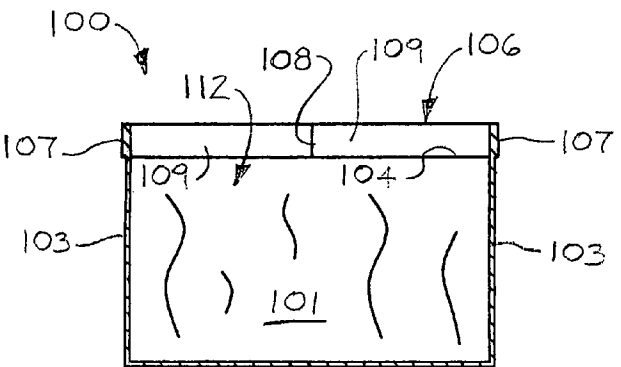
FIG. 3 is a longitudinal sectional view taken along section lines 3-3 in FIG. 2.

A sleeve rim 106 may extend along the top panel edges 104 of the sleeve panels 101. As illustrated in FIG. 1, the sleeve rim 106 may be generally opposite and parallel to the longitudinal panel seam 102. A pair of sleeve rim side bends 107 may be provided in the sleeve rim 106 at the respective lateral panel seams 103. A pair of sleeve rim center bends 108 may be provided generally opposite each other in the sleeve rim 106 between the sleeve rim side bends 107. As illustrated in FIG. 2, generally straight sleeve rim segments 109 may extend between each sleeve rim side bend 107 and the adjacent sleeve rim center bend 108. The sleeve rim side bends 107 and the sleeve rim center bends 108 may function as hinges to impart flexibility to the sleeve rim 106. The sleeve rim 106 may normally be biased in an open, outwardly-expanded diamond-shaped configuration as illustrated in FIG. 2. Responsive to inward application of finger pressure (not illustrated) to the sleeve rim center bends 108, the sleeve rim 106 is capable of deforming to a closed position (not illustrated). Upon release of the finger pressure from the sleeve rim center bends 108, the sleeve rim 106 flexes back to the open position illustrated in FIG. 2.

Each sleeve panel 101 and the sleeve rim 106 may be any type of flexible material having characteristics which are consistent with the functional requirements of the credit card swipe sleeve 100. Examples of materials which are suitable for each sleeve panel 101 and the sleeve rim 106 include but are not limited to polyethylene (low-density, LDPE or linear low-density, LLDPE), nonwoven fabrics and plastic textiles.

Figure 4:
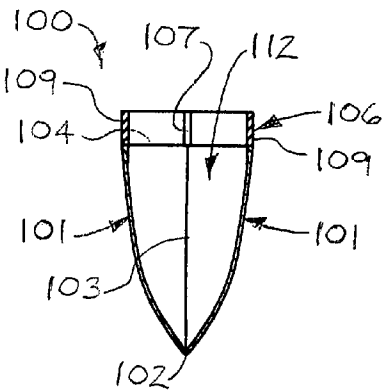
FIG. 4 is a transverse sectional view taken along section lines 4-4 in FIG. 2.

The sleeve panels 101 and the sleeve rim 106 may be fabricated in one piece using conventional molding or other techniques which are known by those skilled in the art. Each sleeve panel 101 may taper from the sleeve rim 106 in a one-piece construction with the sleeve rim 106 notably thicker than each sleeve panel 101, as illustrated in FIG. 4. In some embodiments, each sleeve panel 101 may have a thickness of at least about 0.8 mm. In some methods of fabrication, the sleeve panels 101 and the sleeve rim 106 may be fabricated separately and then attached to each other using heat forming, adhesives or other attachment methods known by those skilled in the art.

Figure 6:
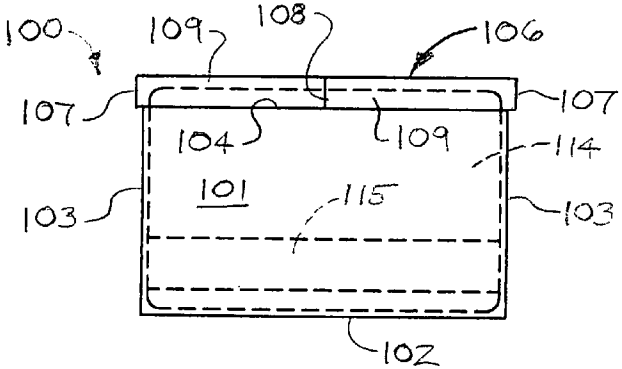
FIG. 6 is a front view of the illustrative credit card swipe sleeve with the credit card (illustrated in phantom) inserted in the credit card swipe sleeve.
Figure 7:
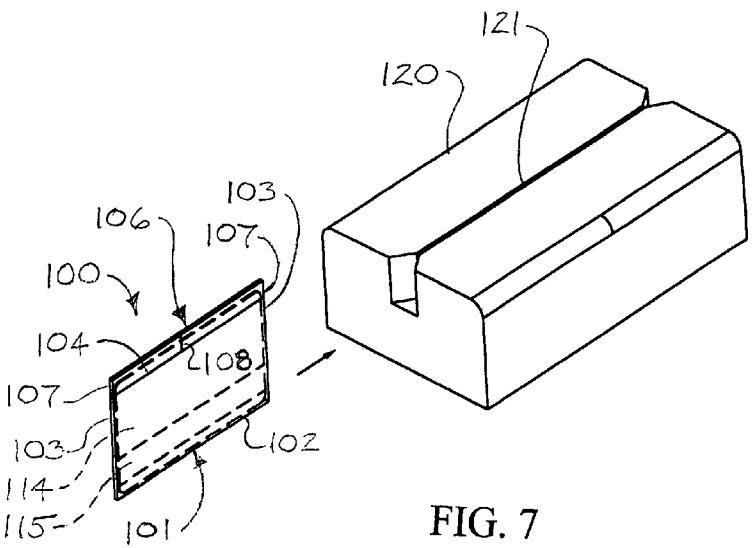
FIG. 7 is a perspective view of a credit card reading device, more particularly illustrating swiping of the illustrative credit card swipe sleeve with the credit card (illustrated in phantom) contained therein in the credit card reading device in exemplary application of the credit card swipe sleeve.
Figure 5:
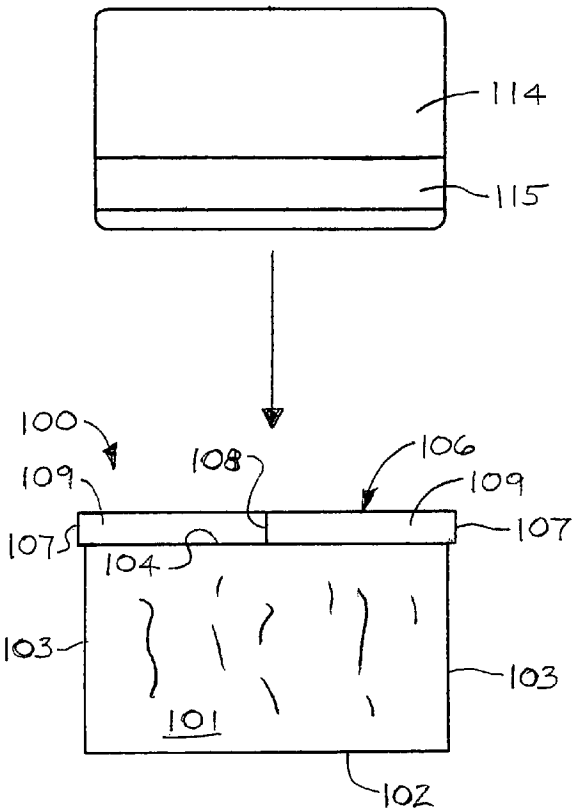
FIG. 5 is an exploded side view illustrating insertion of a credit card into the illustrative credit card swipe sleeve illustrated in FIG. 1 in exemplary application of the credit card swipe sleeve.

As illustrated in FIGS. 5-7, in exemplary application of the credit card swipe sleeve 100, a credit card 114 is presented for payment of goods or services at a retail establishment or the like. A sales clerk or other personnel (not illustrated) who handles the sale initially places the credit card 114 in the sleeve interior 112 (FIG. 2) of the credit card swipe sleeve 100. As illustrated in FIG. 6, the credit card 114 may be oriented such that the magnetic stripe 115 is placed nearer the longitudinal panel seam 102 than the sleeve rim 106. The sales clerk or other personnel then grips the sleeve rim 106 and applies finger pressure to the sleeve rim center bends 108 to deform the sleeve rim 106 inwardly and cause firm engagement of the sleeve rim 106 against the opposite surfaces of the credit card 114.

The sales clerk or other personnel then applies the sleeve rim 106 against opposite surfaces of the credit card 114 by applying inward pressure on the sleeve rim 106 at the sleeve rim center bends 108. Next, as illustrated in FIGS. 7 and 8, the credit card swipe sleeve 100 with the credit card 114 contained therein is swiped through a credit card slot 121 in a credit card reading device 120 having a card reading mechanism 122 (FIG. 9). The card reading mechanism 122 of the credit card reading device 120 may be a conventional retail-type credit card reading device which is well-known by those skilled in the art. In some applications, the credit card reading device 120 may include an induction coil (not illustrated) which detects a succession of magnetic and non-magnetic zones in the magnetic stripe 115 of the credit card 114 and creates electrical pulses as the magnetic zones pass the induction coil while the credit card 114 is swiped. As illustrated in FIG. 9, as the credit card swipe sleeve 100 travels through the credit card slot 121 of the credit card reading device 120, the sleeve panel 101 of the credit card swipe sleeve 100 maintains distance or spacing between the magnetic stripe 115 (FIG. 5) on the credit card 114 and the card reading mechanism 122. In the event that the magnetic stripe 115 has scratches or other defects (not illustrated) which may otherwise cause spikes in the pulses created by the induction coil in the card reading mechanism 122, the distance or spacing between the magnetic stripe 115 and the card reading mechanism 122 reduces the strength of the pulses and smoothes out fluctuations or spikes in the pulses. This pulse attenuating effect enables the credit card reading device 120 to correctly read or decipher the data encoded on the magnetic stripe 115 and authorize the sale. Accordingly, the spacing between the magnetic strip 115 and the card reading mechanism 122 which is maintained by the thickness of the sleeve panel 101 enhances accuracy of the credit card reading device 120 in reading the credit card account information encoded on the magnetic stripe 115 and eliminates or reduces the likelihood that the credit card reading device 120 will decline the credit card 114. After use, the credit card 114 may be removed from the credit card swipe sleeve 100, which may be discarded or re-used. In some applications, the credit card 114 may be stored in the credit card swipe sleeve 100 which may be carried in a wallet (not illustrated), a purse (not illustrated) or other enclosure or container.

Referring next to FIGS. 10 and 11 of the drawings, an alternative illustrative embodiment of the credit card swipe sleeve is generally indicated by reference numeral 200. In the credit card swipe sleeve 200, elements which are analogous to the respective elements designated in the 100 series of the credit card swipe sleeve 100 that was heretofore described with respect to FIGS. 1-4 are designated by the same numeral in the 200 series in FIGS. 10 and 11. The sleeve rim 206 of the credit card swipe sleeve 200 may project outwardly at an obtuse angle to the plane of each sleeve panel 201. Accordingly, the outwardly-angled sleeve rim 206 may facilitate ease in placement of the credit card 114 into and removal of the credit card 114 from the sleeve interior 212 of the credit card swipe sleeve 200. Use of the credit card swipe sleeve 200 may be as was heretofore described with respect to the credit card swipe sleeve 100 in FIGS. 5-9.

Referring next to FIGS. 12 and 13 of the drawings, another illustrative embodiment of the credit card swipe sleeve 300 is illustrated. In the credit card swipe sleeve 300, elements which are analogous to the respective elements designated in the 100 series of the credit card swipe sleeve 100 that was heretofore described with respect to FIGS. 1-4 are designated by the same numeral in the 300 series in FIGS. 12 and 13. The sleeve rim 306 of the credit card swipe sleeve 300 may be flared outwardly from the sleeve panels 301 as was heretofore described with respect to the sleeve rim 206 of the credit card swipe sleeve 200 in FIGS. 10 and 11. The sleeve rim 306 of the credit card swipe sleeve 300 may extend further toward the longitudinal panel seam 302 than the sleeve rim 206 of the credit card swipe sleeve 200 in FIGS. 10 and 11 for enhanced rigidity of the credit card swipe sleeve 300. Use of the credit card swipe sleeve 300 may be as was heretofore described with respect to the credit card swipe sleeve 100 in FIGS. 5-9.

Figure 15:
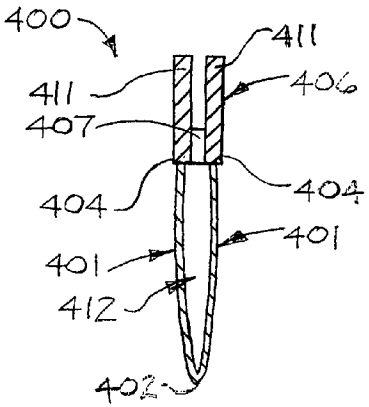
FIG. 15 is a transverse sectional view taken along section lines 15-15 in FIG. 14.
Figure 14:
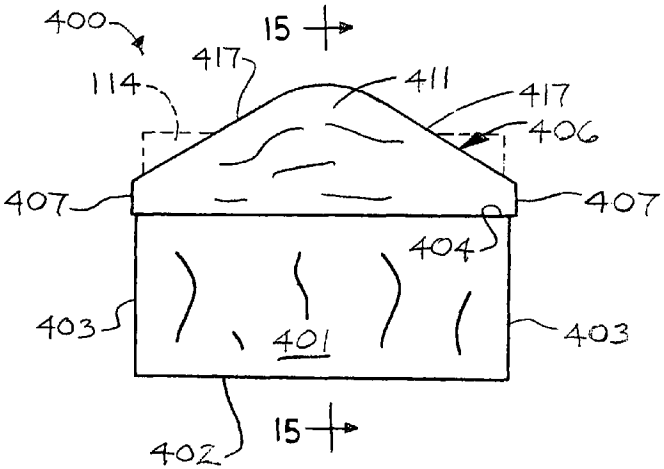
FIG. 14 is a side view of still another illustrative embodiment of the credit card swipe sleeve.

Referring next to FIGS. 14 and 15 of the drawings, another illustrative embodiment of the credit card swipe sleeve 400 is illustrated. In the credit card swipe sleeve 400, elements which are analogous to the respective elements designated in the 100 series of the credit card swipe sleeve 100 that was heretofore described with respect to FIGS. 1-4 are designated by the same numeral in the 400 series in FIGS. 14 and 15. The sleeve rim 406 of the credit card swipe sleeve 400 may include a pair of sleeve rim tabs 411 which extend from the top panel edges 404 of the respective sleeve panels 401. As illustrated in FIG. 15, the sleeve rim tabs 411 of the sleeve rim 406 may be disposed in generally parallel, adjacent, spaced-apart relationship to each other. Sleeve rim side bends 407 may attach the sleeve rim tabs 411 to each other at opposite ends of the sleeve rim 406. As illustrated in FIG. 14, each sleeve rim tab 411 may have a pair of sloped tab edges 417. Accordingly, as further illustrated in FIG. 14, when inserted in the sleeve interior 412 (FIG. 15), the corners of the credit card 114 may protrude beyond the sloped tab edges 417 of the sleeve rim tab 411 to facilitate ease in insertion and removal of the credit card 114.

Use of the credit card swipe sleeve 400 may be as was heretofore described with respect to the credit card swipe sleeve 100 in FIGS. 5-9. In use of the credit card swipe sleeve 400, the sleeve rim tabs 411 of the sleeve rim 406 may be pressed against the opposite sides of the credit card 114 as the credit card sleeve 400 is swiped in the credit card reading device 120.

Figure 17:
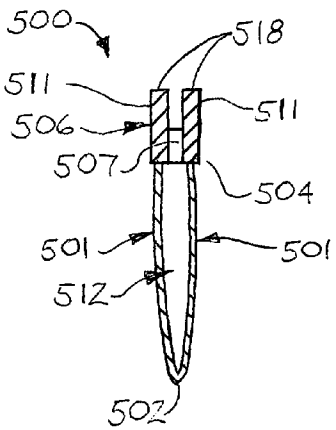
FIG. 17 is a transverse sectional view taken along section lines 17-17 in FIG. 16.
Figure 16:
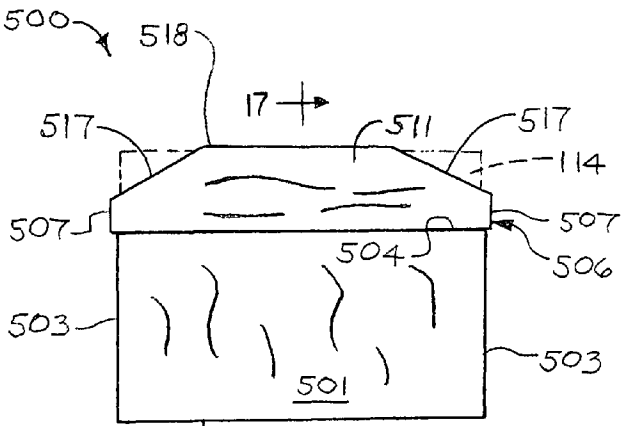
FIG. 16 is a side view of yet another illustrative embodiment of the credit card swipe sleeve.

Referring next to FIGS. 16 and 17 of the drawings, another illustrative embodiment of the credit card swipe sleeve 500 is illustrated. In the assembly 500, elements which are analogous to the respective elements designated in the 100 series of the credit card swipe sleeve 100 that was heretofore described with respect to FIGS. 1-4 are designated by the same numeral in the 500 series in FIGS. 16 and 17. The sleeve rim 506 of the credit card swipe sleeve 500 may include a pair of sleeve rim tabs 511 which extend from the top panel edges 504 of the respective sleeve panels 501. As illustrated in FIG. 17, the sleeve rim tabs 511 may be disposed in generally parallel, adjacent, spaced-apart relationship to each other. Sleeve rim side bends 507 may attach the sleeve rim tabs 511 to each other at opposite ends of the sleeve rim 506. As illustrated in FIG. 16, each sleeve rim tab 511 may have a pair of sloped tab edges 517 and a truncated tab edge 518 which extends between the sloped tab edges 517. Accordingly, as further illustrated in FIG. 16, when inserted in the sleeve interior 512 (FIG. 17), the corners of the credit card 114 may protrude beyond the sloped tab edges 517 of the sleeve rim tab 511 to facilitate ease in insertion and removal of the credit card 114. Use of the credit card swipe sleeve 500 may be as was heretofore described with respect to the credit card swipe sleeve 400 in FIGS. 14 and 15.

Figure 19:
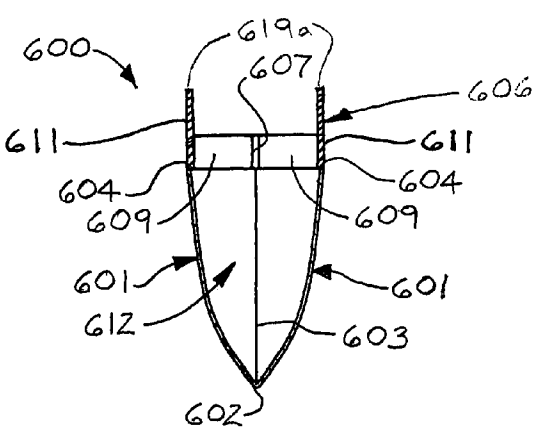
FIG. 19 is a transverse sectional view taken along section lines 19-19 in FIG. 18.
Figure 18:
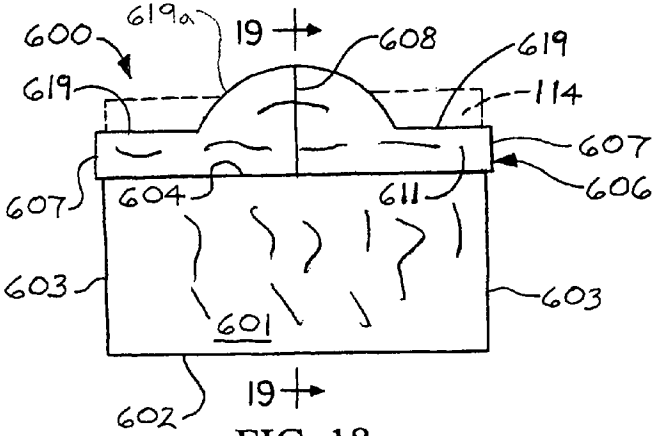
FIG. 18 is a side view of still another illustrative embodiment of the credit card swipe sleeve.
Figure 21:
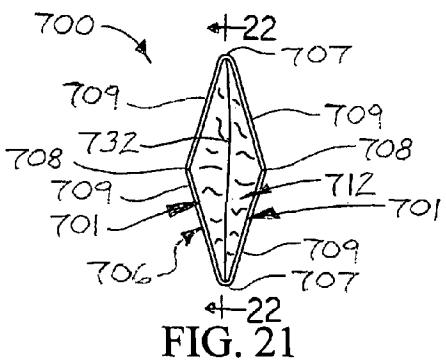
FIG. 21 is a front view taken along viewing lines 21-21 in FIG. 20.

Referring next to FIGS. 18 and 19 of the drawings, another illustrative embodiment of the credit card swipe sleeve 600 is illustrated. In the credit card swipe sleeve 600, elements which are analogous to the respective elements designated in the 100 series of the credit card swipe sleeve 500 that was heretofore described with respect to FIGS. 16 and 17 are designated by the same numeral in the 600 series in FIGS. 18 and 19. The sleeve rim 606 of the credit card swipe sleeve 600 may include a pair of adjacent, spaced-apart sleeve rim tabs 611. A pair of opposite sleeve rim center bends 608 (one of which is illustrated in FIG. 18) may be provided in the respective sleeve rim tabs 611. The sleeve rim tabs 611 of the sleeve rim 606 may each have a straight tab edge 619. A pair of opposite curved tab edges 619*a* may extend from the respective sleeve rim tabs 611. Accordingly, as further illustrated in FIG. 18, when inserted in the sleeve interior 612 (FIG. 19), the credit card 114 may protrude beyond the straight tab edges 619 of the sleeve rim 606 to facilitate ease in insertion and removal of the credit card 114. Use of the credit card swipe sleeve 600 may be as was heretofore described with respect to the credit card swipe sleeve 400 in FIGS. 14 and 15. As was heretofore described with respect to the credit card swipe sleeve 100 in FIG. 2, the sleeve rim tab 611 may normally be disposed in an open, outwardly-expanded configuration. Responsive to inward application of finger pressure (not illustrated) to the sleeve rim center bends 608, the sleeve rim 606 is capable of deforming to a closed position (not illustrated). Upon release of the finger pressure from the sleeve rim center bends 608, the sleeve rim 606 flexes back to the open position.

Figure 20:
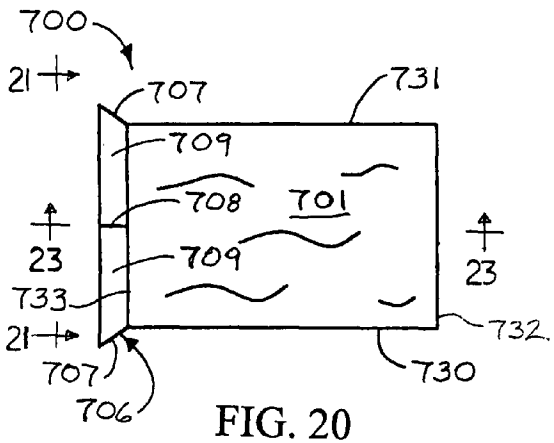
FIG. 20 is a side view of another illustrative embodiment of the credit card swipe sleeve.
Figure 23:
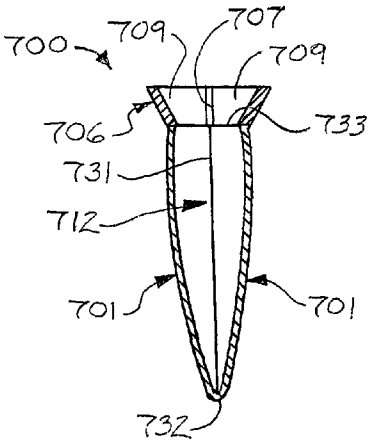
FIG. 23 is a transverse sectional view taken along section lines 23-23 in FIG. 20.
Figure 22:
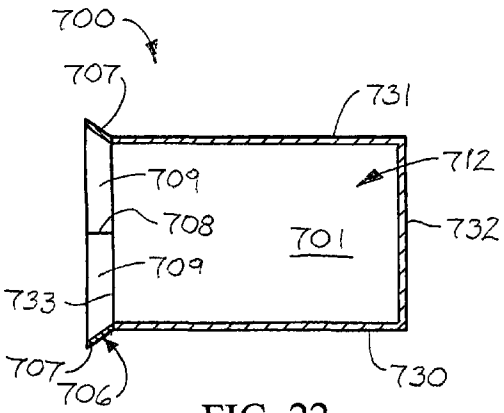
FIG. 22 is a longitudinal sectional view taken along section lines 22-22 in FIG. 21.

Referring next to FIGS. 20-25 of the drawings, another illustrative embodiment of the credit card swipe sleeve is generally indicated by reference numeral 700. In the credit card swipe sleeve 700, elements which are analogous to the respective elements designated in the 100 series of the credit card swipe sleeve 100 that was heretofore described with respect to FIGS. 1-4 are designated by the same numeral in the 700 series in FIGS. 20-25. The sleeve panels 701 of the credit card swipe sleeve 700 may be attached to each other along longitudinal panel seams 730, 731 and a lateral panel seam 732. The sleeve rim 706 may extend from end panel edges 733 of the respective sleeve panels 701, which end panel edges 733 are opposite the lateral panel seam 732. As illustrated in FIG. 20, the sleeve rim 706 may be generally opposite and parallel to the lateral panel seam 732. In some embodiments, the sleeve rim 706 of the credit card swipe sleeve 700 may project outwardly at an obtuse angle to the plane of each sleeve panel 701, as illustrated.

Figure 24:
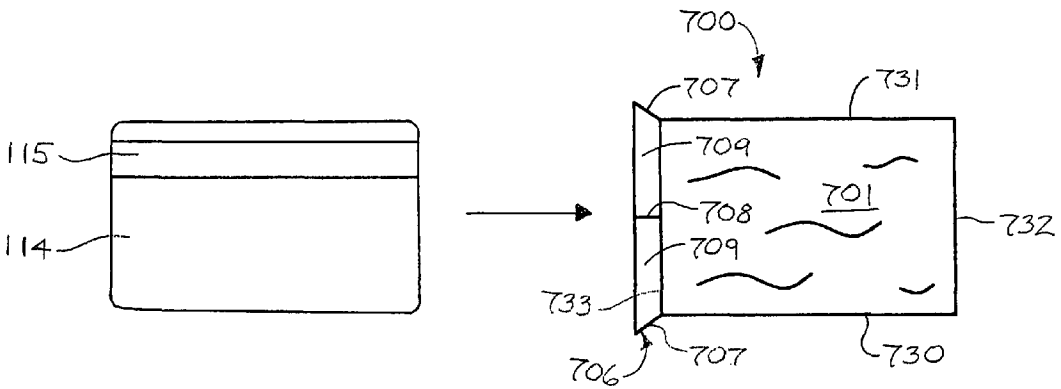
FIG. 24 is an exploded side view illustrating insertion of a credit card in the credit card swipe sleeve illustrated in FIG. 20.
Figure 25:
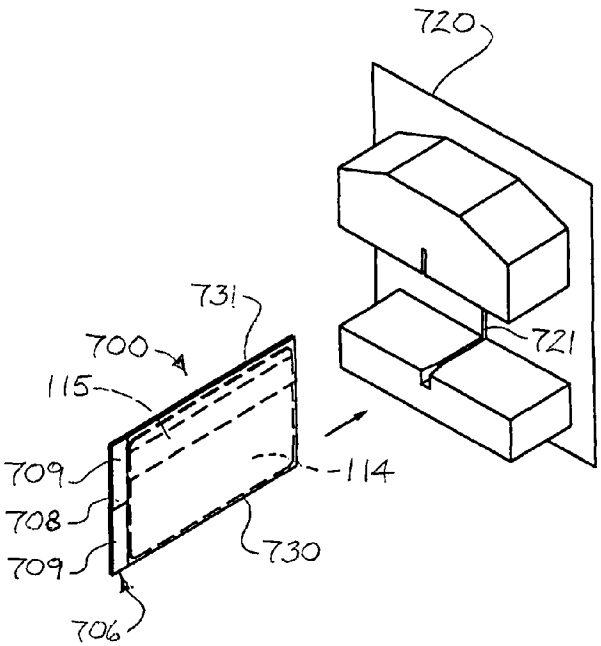
FIG. 25 is a perspective view of an insertion-type credit card reading device, more particularly illustrating insertion of the illustrative credit card swipe sleeve illustrated in FIG. 20 with the credit card (illustrated in phantom) contained therein in the credit card reading device in exemplary application of the credit card swipe sleeve.

As illustrated in FIGS. 24 and 25, in exemplary application, the credit card swipe sleeve 700 is suitable for enclosing a credit card 114 as the credit card 114 is inserted or swiped in a self-service type of credit card reading device 720 which is commonly used on fuel pumps at gas stations and the like. As illustrated in FIG. 24, the credit card 114 is initially placed in the sleeve interior 712 (FIG. 23) of the credit card swipe sleeve 700. As illustrated in FIG. 25, the credit card 114 may be oriented such that the magnetic stripe 115 is placed nearer the top panel seam 731 than the longitudinal panel seam 730. The user of the credit card 114 then grips the sleeve rim 706 and applies finger pressure to the sleeve rim center bends 708 to deform the sleeve rim 706 inwardly and cause firm engagement of the sleeve rim 706 against the opposite surfaces of the credit card 114.

Next, as illustrated in FIG. 25, the credit card swipe sleeve 700 with the credit card 114 contained therein is inserted or swiped in a credit card slot 721 in a credit card reading device 720. The credit card reading device 720 may be a conventional self-service type of credit card reading device which is commonly utilized at gas station pumps and the like. The credit card reading device 720 may include a card reading mechanism such as that which was heretofore described with respect to the card reading mechanism 122 in FIG. 9. As the credit card swipe sleeve 700 is inserted into the credit card slot 721 of the credit card reading device 720, the sleeve panel 701 of the credit card swipe sleeve 700 maintains distance or spacing between the magnetic strip 115 on the credit card 114 and the card reading mechanism of the credit card reading device 720. In the event that the magnetic stripe 115 has scratches or other defects (not illustrated) which may otherwise cause spikes in the pulses created by the induction coil in the card reading mechanism, the distance or spacing between the magnetic stripe 115 and the card reading mechanism reduces the strength of the pulses and smoothes out fluctuations or spikes in the pulses. This pulse attenuating effect enables the credit card reading device 720 to correctly read or decipher the data encoded on the magnetic stripe 115 and authorize the sale. Accordingly, the spacing between the magnetic stripe 115 and the card reading mechanism which is maintained by the thickness of the sleeve panel 701 enhances accuracy of the credit card reading device 720 in reading the credit card account data encoded on the magnetic strip 115 and eliminates or reduces the likelihood that the card reading mechanism of the credit card reading device 720 will decline the credit card 114.

Figure 26:
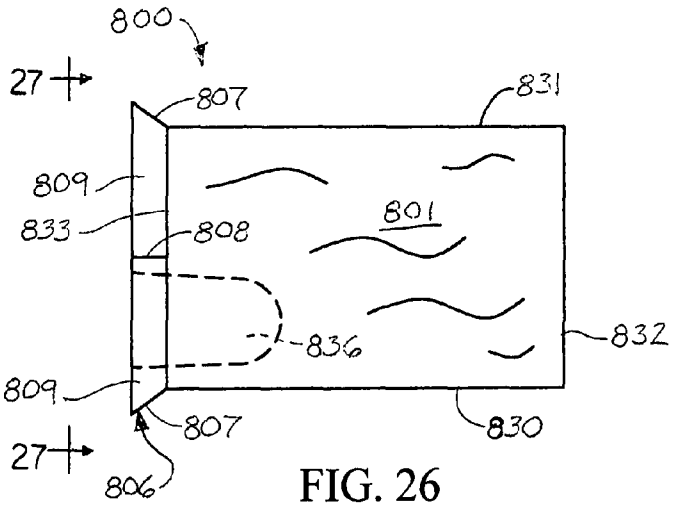
FIG. 26 is a side view of another illustrative embodiment of the credit card swipe sleeve.
Figure 27:
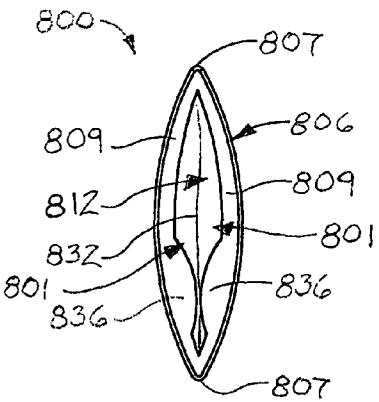
FIG. 27 is a front view taken along viewing lines 27-27 in FIG. 26.

Referring next to FIGS. 26 and 27 of the drawings, an alternative illustrative embodiment of the credit card swipe sleeve is generally indicated by reference numeral 800. In the credit card swipe sleeve 800, elements which are analogous to the respective elements designated in the 100 series of the credit card swipe sleeve 100 that was heretofore described with respect to FIGS. 1-4 are designated by the same numeral in the 800 series in FIGS. 26 and 27. A pair of finger tabs 836 may extend into the sleeve interior 812 from opposite sides of the sleeve rim 806. The finger tabs 836 may be a semi-rigid flexible material. Accordingly, as the credit card swipe sleeve 800 with the credit card 114 contained therein is inserted into the credit card slot 721 of the credit card reading device 720, the user grips the finger tabs 836 typically using his or her thumb and index finger and presses the finger tabs 836 against opposite surfaces of the credit card 114. The finger tabs 836 enhance finger gripping of the credit card swipe sleeve 800 as the credit card swipe sleeve 800 is inserted into and removed from the credit card slot 721 of the credit card reading device 700.

It will be appreciated by those skilled in the art that the various embodiments of the credit card swipe sleeve described herein provide an effective manner of swiping a credit card in a credit card reading device to ensure that the credit card reading device authorizes the card for payment of a good or service. In some applications, a supply of multiple credit card swipe sleeves may be packaged and dispensed from a dispensing box which is suitable for the purpose. The dispensing box may be maintained in a location which is readily accessible to a store clerk or other user who removes a credit card swipe sleeve from the dispensing box and uses the credit card swipe sleeve to swipe the credit card of a customer or the user's own credit card. Each credit card swipe sleeve may be discarded after use or alternatively, may be re-used. In some applications, a supply of multiple credit card swipe sleeves may be attached to each other along perforations and wound on a spool or the like. The spool can be mounted in a location which is accessible to a store clerk or other person who tears each individual sleeve from the spool-wound sleeves for use.

Figure 28:
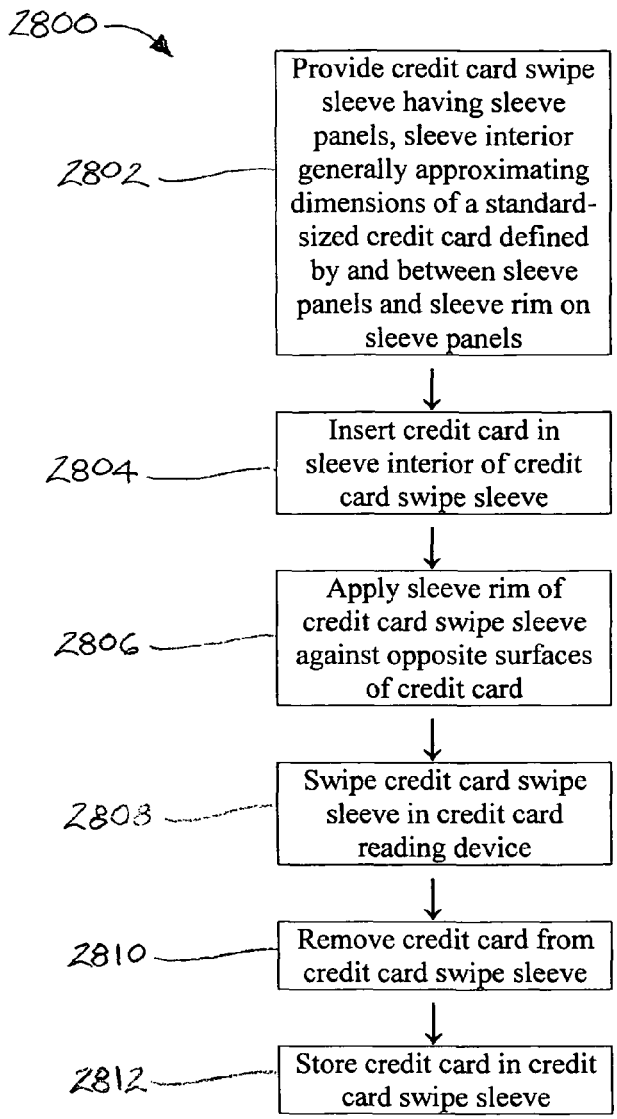
FIG. 28 is a flow diagram of an illustrative embodiment of a credit card swipe method.

Referring next to FIG. 28 of the drawings, a flow diagram 2800 of an illustrative embodiment of a credit card swipe method is illustrated. In block 2802, a credit card swipe sleeve is provided. The credit card swipe sleeve may include a pair of sleeve panels, a sleeve interior generally approximating dimensions of a standard-sized credit card defined by and between the sleeve panels and a sleeve rim on the sleeve panels. In block 2804, a credit card is inserted in the sleeve interior of the credit card swipe sleeve. In block 2806, the sleeve rim of the credit card swipe sleeve is applied against opposite surfaces of the credit card. In block 2808, the credit card swipe sleeve with the credit card contained therein is swiped in a retail-type credit card reading device at a retail establishment. Alternatively, the credit card swipe sleeve and the credit card contained therein may be inserted into and removed from a self-service type of credit card reading device which is commonly used on fuel pumps at gas stations and the like. In block 2810, the credit card may be removed from the credit card swipe sleeve. In other applications (block 2812), the credit card may be stored in the credit card swipe sleeve. The credit card swipe sleeve with the credit card contained therein may be placed in a wallet, purse or other enclosure or container (not illustrated).

While illustrative embodiments of the disclosure have been described above, it will be recognized and understood that various modifications can be made in the disclosure and the appended claims are intended to cover all such modifications which may fall within the spirit and scope of the disclosure.

What is claimed is:

1. A credit card swipe sleeve, comprising:

a pair of sleeve panels;

a plurality of panel seams attaching said sleeve panels;

a sleeve interior defined by and between said sleeve panels, said sleeve interior generally approximating dimensions of a standard-sized credit card; and a flexible sleeve rim carried by said pair of sleeve panels and deployable from an outwardly-expanded open configuration to a closed configuration responsive to inward pressure applied to said sleeve rim, said sleeve rim having a pair of sleeve rim side bends and a pair of sleeve rim center bends between said sleeve rim side bends and wherein said sleeve rim flexes along said pair of sleeve rim side bends and said pair of sleeve rim end bends as said sleeve rim deploys between said open configuration and said closed configuration.

2. The credit card swipe sleeve of claim 1 wherein said sleeve rim comprises sleeve rim segments extending between adjacent ones of said pair of sleeve rim side bends and said pair of sleeve rim end bends.

3. The credit card swipe sleeve of claim 1 wherein said sleeve rim is normally biased in said open configuration.

4. The credit card swipe sleeve of claim 1 wherein said plurality of panel seams comprises a longitudinal panel seam and a pair of spaced-apart, parallel lateral panel seams generally perpendicular to said longitudinal panel seam, and wherein said sleeve rim is generally opposite and parallel to said longitudinal panel seam.

5. The credit card swipe sleeve of claim 1 wherein said sleeve rim projects outwardly at an obtuse angle to each of said pair of sleeve panels.

6. The credit card swipe sleeve of claim 1 wherein said plurality of panel seams comprises a pair of spaced-apart, parallel longitudinal panel seams and a lateral panel seam generally perpendicular to said pair of longitudinal panel seams, and wherein said sleeve rim is generally opposite and parallel to said lateral panel seam.

7. The credit card swipe sleeve of claim 1 further comprising a pair of spaced-apart finger tabs extending from said sleeve rim into said sleeve interior.

8. A credit card swipe sleeve, comprising:

a pair of sleeve panels;

a plurality of panel seams attaching said sleeve panels;

a sleeve interior defined by and between said sleeve panels, said sleeve interior generally approximating dimensions of a standard-sized credit card; and a flexible sleeve rim carried by said pair of sleeve panels and having a pair of generally elongated, spaced-apart sleeve rim tabs, each of said sleeve rim tabs having a pair of sloped tab edges.

9. The credit card swipe sleeve of claim 8 further comprising a truncated tab edge extending between said sloped tab edges.

10. The credit card swipe sleeve of claim 8 wherein each of said sleeve rim tabs comprises a pair of straight tab edges and a curved tab edge extending from said straight tab edges.

11. The credit card swipe sleeve of claim 10 further comprising a pair of sleeve rim side rims and a pair of sleeve rim center bends in said pair of sleeve rim tabs, respectively.

12. The credit card swipe sleeve of claim 11 wherein said sleeve rim is normally biased in an open configuration.

13. The credit card swipe sleeve of claim 8 wherein said plurality of panel seams comprises a longitudinal panel seam and a pair of spaced-apart, parallel lateral panel seams generally perpendicular to said longitudinal panel seam, and wherein said sleeve rim is generally opposite and parallel to said longitudinal panel seam.

14. A credit card swipe method, comprising:

providing a credit card swipe sleeve having sleeve panels, a sleeve interior generally approximating dimensions of a standard-sized credit card defined by and between said sleeve panels and a sleeve rim on said sleeve panels, said sleeve rim having a pair of sleeve rim side bends and a pair of sleeve rim center bends between said sleeve rim side bends and wherein said sleeve rim flexes along said pair of sleeve rim side bends and said pair of sleeve rim end bends as said sleeve rim deploys between said open configuration and said closed configuration;

inserting a credit card in said sleeve interior of said credit card swipe sleeve;

applying said sleeve rim of said credit card swipe sleeve against opposite surfaces of said credit card; and swiping said credit card swipe sleeve in a credit card reading device.

15. The credit card swipe method of claim 14 further comprising removing said credit card from said credit card swipe sleeve.

16. The credit card swipe method of claim 14 further comprising storing said credit card in said credit card swipe sleeve.

17. The credit card swipe method of claim 14 wherein said swiping said credit card swipe sleeve in a credit card reading device comprises swiping said credit card swipe sleeve in a retail-type credit card reading device.

18. The credit card swipe method of claim 14 wherein said swiping said credit card swipe sleeve in a credit card reading device comprises swiping said credit card swipe sleeve in a self-service type credit card reading device.

* * * * *